US011878227B2

(12) United States Patent
Wang

(10) Patent No.: US 11,878,227 B2
(45) Date of Patent: Jan. 23, 2024

(54) BALL CONTROL SKILL TRAINING DEVICE FOR ICE HOCKEY

(71) Applicant: Potent Sports & Tech Co., Ltd, Jiangsu (CN)

(72) Inventor: Li Wang, Jiangsu (CN)

(73) Assignee: Potent Sports & Tech Co., Ltd., Nantong (CN)

( * ) Notice: Subject to any disclaimer, the term of this patent is extended or adjusted under 35 U.S.C. 154(b) by 726 days.

(21) Appl. No.: 16/967,143

(22) PCT Filed: Jun. 17, 2020

(86) PCT No.: PCT/CN2020/096593
§ 371 (c)(1),
(2) Date: Aug. 4, 2020

(87) PCT Pub. No.: WO2021/253285
PCT Pub. Date: Dec. 23, 2021

(65) Prior Publication Data

US 2023/0166169 A1 Jun. 1, 2023

(51) Int. Cl.
*A63B 69/00* (2006.01)
*A63B 102/26* (2015.01)

(52) U.S. Cl.
CPC ..... *A63B 69/0026* (2013.01); *A63B 2102/26* (2015.10); *A63B 2220/17* (2013.01); *A63B 2220/833* (2013.01); *A63B 2225/74* (2020.08)

(58) Field of Classification Search
CPC ..... A63B 69/0026; A63B 2225/74; A63B 220/17; A63B 2220/833
USPC ..... 473/446
See application file for complete search history.

(56) References Cited

U.S. PATENT DOCUMENTS

| | | | | |
|---|---|---|---|---|
| 5,769,742 | A * | 6/1998 | Bristow | A63B 69/0024 473/446 |
| 6,656,064 | B2 * | 12/2003 | Zielinski | A63B 69/0024 473/446 |
| 8,182,373 | B2 * | 5/2012 | Delorme | A63B 69/0026 473/446 |
| 10,668,347 | B2 * | 6/2020 | Bartels | A63B 63/00 |
| 10,898,777 | B2 * | 1/2021 | Sutta | A63B 69/0024 473/446 |

(Continued)

*Primary Examiner* — Mitra Aryanpour
(74) *Attorney, Agent, or Firm* — Zhigang Ma

(57) ABSTRACT

Disclosed is an ice hockey ball-controlling skill training device, which comprises a plurality of cross members hinged end to end, and the connecting ends of adjacent two cross members are provided with fixing components for connecting and fixing; the training device also compromises a ball, LED lighting components, and induction components, the induction component compromises a plurality of Hall elements and electromagnetic induction elements, a plurality of Hall elements are respectively arranged on a plurality of cross members, the electromagnetic induction elements are arranged in the ball; when the ball passes under the cross member, the electromagnetic induction elements can triggers induction with Hall elements. During the training process, when the ball passes under the cross member, the electromagnetic induction element can trigger induction with the Hall element. Compared with the ball control device in the prior art, the device has more accurate induction.

6 Claims, 4 Drawing Sheets

(56) References Cited

U.S. PATENT DOCUMENTS

| | | | | |
|---|---|---|---|---|
| 2008/0287224 | A1* | 11/2008 | Salvador | A63B 69/0024<br>473/446 |
| 2023/0081027 | A1* | 3/2023 | Lozinski | A63B 69/0024 |

* cited by examiner

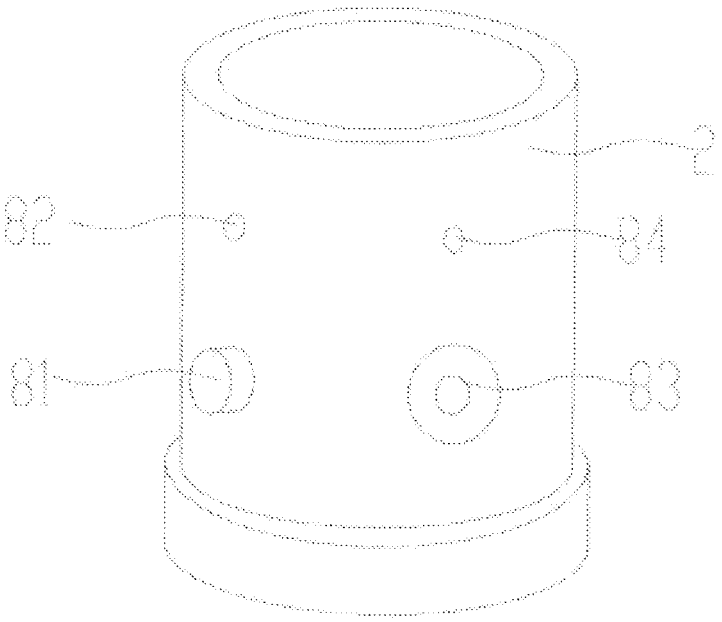
Fig. 4
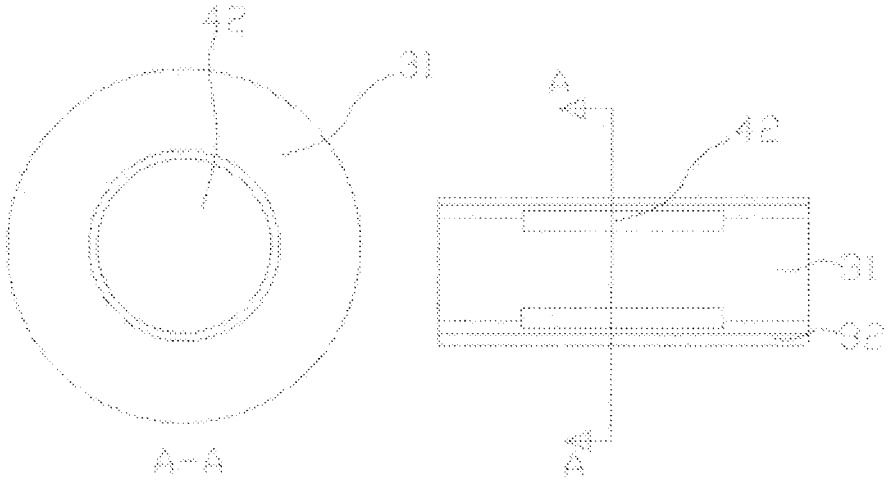
Fig. 5A
Fig. 5B
Fig. 5

BALL CONTROL SKILL TRAINING DEVICE FOR ICE HOCKEY

BACKGROUND OF INVENTION

1. Field of the Invention

The present invention relates to the technical field of training equipment, in particular to a ball control skill training device for ice hockey.

2. Description of Related Art

The important basic skills of ice hockey are ball-controlling, passing, shooting, and sliding skills. They are the skills used by players to perform point and surface skills in ice hockey games, and are the means to achieve tactical cooperation in ice hockey. The ball-controlling dribble skill is the most basic and important ball-controlling skill, and is often used when fighting, passing, shaking the goalkeeper, preparing to pass and shoot. Therefore, it is necessary to develop a digital ball control skill training device that can train athletes in ball control training and ball control reaction training, so that athletes can gradually improve the level of ball control under the digital scene training method and objectively understand their own level of ball control, and remind them to grasp the opportunity of passing shots. The training device is used for setting goals and progressively improving skill ability.

For example, the invention patent with the patent number "201721533187.7" discloses an intelligent ball control device for ice hockey, which can solve the above problems. However, since the training device adopts infrared for counting induction, during the use process, whether the ball passes, the non-ball passes, or the club accidentally touches the cross-members, etc., the counting induction will be triggered. Undoubtedly, the induction accuracy of the disclosed training device is low, resulting in low accuracy of training data, thereby reducing the training effect of athletes.

SUMMARY OF THE INVENTION

According to one aspect of the present invention, there is provided an ice hockey ball control skill training device, which compromises a plurality of cross-members hinged end to end, and connecting ends of two adjacent cross-members are provided with a fixing component for connecting and fixing. The ball control technology training device for ice hockey also compromises a ball, an LED lighting component, and an induction component. The induction component compromises a plurality of Hall elements and electromagnetic induction elements, a plurality of Hall elements are respectively arranged on a plurality of cross-members, and the electromagnetic induction elements are arranged in the ball; when the ball passes through the corresponding area under the cross-members, the electromagnetic induction element can trigger induction with the Hall element.

The present invention provides a device for ice hockey ball training. During the training process, when the ball passes the corresponding area under the cross-members, the electromagnetic induction element can trigger induction with the Hall element; compared with the ball control technology in the prior art, the device has a more accurate induction function. The device is improved under the existing technology, and Hall induction is used to improve the precision of the induction, so that the training data of the device is more accurate and the training effect is improved. In some embodiments, the ice hockey ball control skill training device further compromises a controller, a chronograph counter, and a plurality of LED lighting components. The controller is provided on one of the cross-members, and the LED lighting components are respectively provided on the end surfaces of the cross-members. The controller is connected with several LED lighting components and several induction components respectively.

Thus, the controller is used to control the LED lighting components, and cooperate with the induction components to jointly control the LED lighting components.

In some embodiments, the ball control skill training device for ice hockey also compromises a chronograph counter, which is provided on the cross-member, and is connected to a control board component; the c counter is configured to count the induction times of the electromagnetic induction element and the Hall element in the ball.

Thus, the chronograph counter is used to count training data within a predetermined time.

In some embodiments, the ice hockey ball control skill training device further compromises a control switch, which is provided on one of the fixing components.

Thus, the control switch is used to turn on/off the device.

In some embodiments, the ball control skill training device for ice hockey further compromises a mode selection switch, and the mode selection switch is provided on one of the fixing components.

Thus, the mode selection switch is used to select the training difficulty mode of the device.

In some embodiments, the ice hockey ball control technical training device further compromises a charging port and a charging indicator, and the charging port and the charging indicator are provided on one of the fixing components.

Thus, the charging port and the charging indicator are used to charge the device and indicate the power status.

In some embodiments, the fixing components compromises a fixing column and a carriage bolt, and the cross member is installed on the fixing column through the carriage bolt.

Thus, the cross member is installed by the carriage bolts, which is convenient for adjustment and installation.

In some embodiments, the ball compromises a main body and two vertically distributed ball covers. The central portion of the main body is provided with an installation cavity for mounting an electromagnetic induction element. The two ball covers are provided on the upper and lower end surfaces of the main body to seal the installation cavity.

Thus, the electromagnetic induction element is sealed in the installation cavity of the main body, and then encapsulated by two ball covers.

In some embodiments, the ball compromises an electromagnetic induction element wrapped with rubber, and the outside of the rubber is encapsulated by injection molding.

As a result, the electromagnetic induction element is sandwiched between the rubbers and the outside is encapsulated by integral injection molding to seal the electromagnetic induction element.

The beneficial effects of the present invention are specifically embodied in that the ice hockey ball control technology training device provided by the present invention can improve the induction accuracy of the ball passing through the cross member; thereby improving the accuracy of the training data.

BRIEF DESCRIPTION OF THE DRAWINGS

FIG. 4 is a three-dimensional structural schematic view of a fixing component in the ball control skill training device of the ice hockey shown in FIG. 1.

FIG. 5 is a schematic structural top view (FIG. 5A) and cross view (FIG. 5B) of a ball in the ball control training device for the ice hockey shown in FIG. 1

Figure 1:
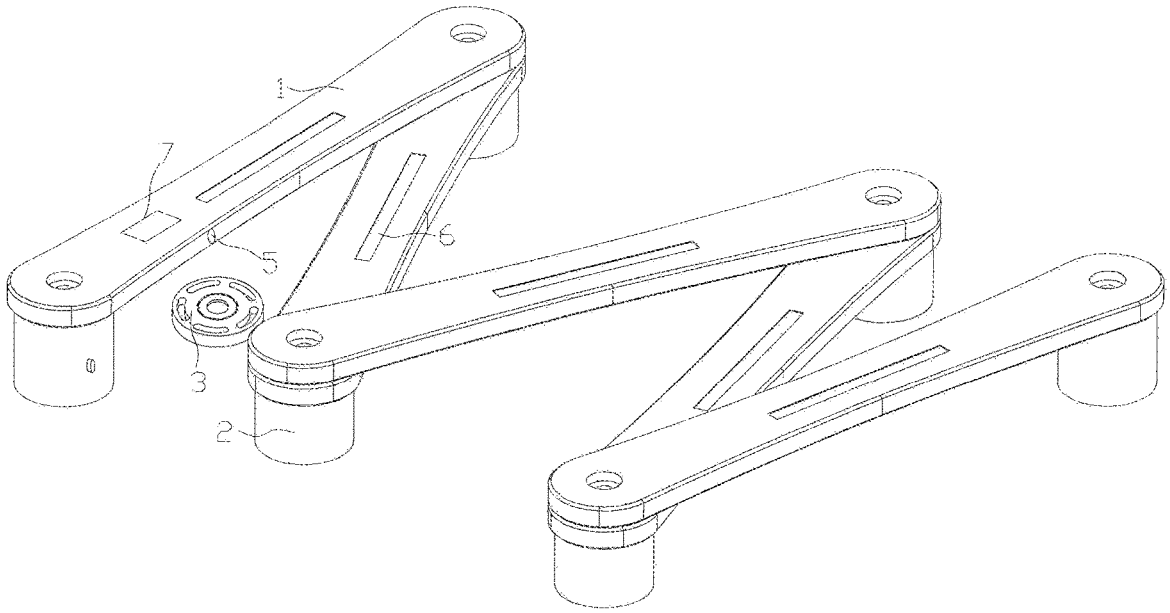
FIG. 1 is a three-dimensional structural schematic view of an ice hockey ball control skill training device according to an embodiment of the present invention.

Reference numbers in the drawings: 1-cross member, 11-connecting hole, 12-limit slot, 2-fixing component, 3-ball, 31-main body, 32-ball cover, 41-Hall element, 42-electromagnetic induction element, 5-controller, 6-lighting component, 7-chronograph counter, 81-control switch, 82-mode selection switch, 83-charging port, 84-charging indicator.

DETAILED DESCRIPTION OF THE INVENTION

The present invention will be described in further detail below with reference to the drawings.

Embodiment 1

Figure 2:
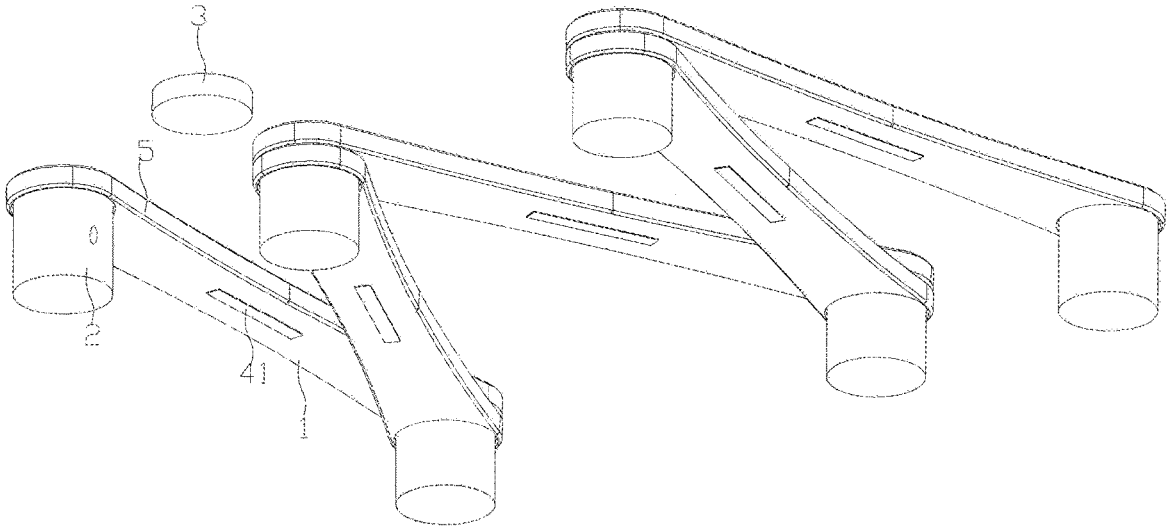
FIG. 2 is a three-dimensional structural schematic view of the ice hockey ball control skill training device shown in FIG. 1 from another perspective.
Figure 3:
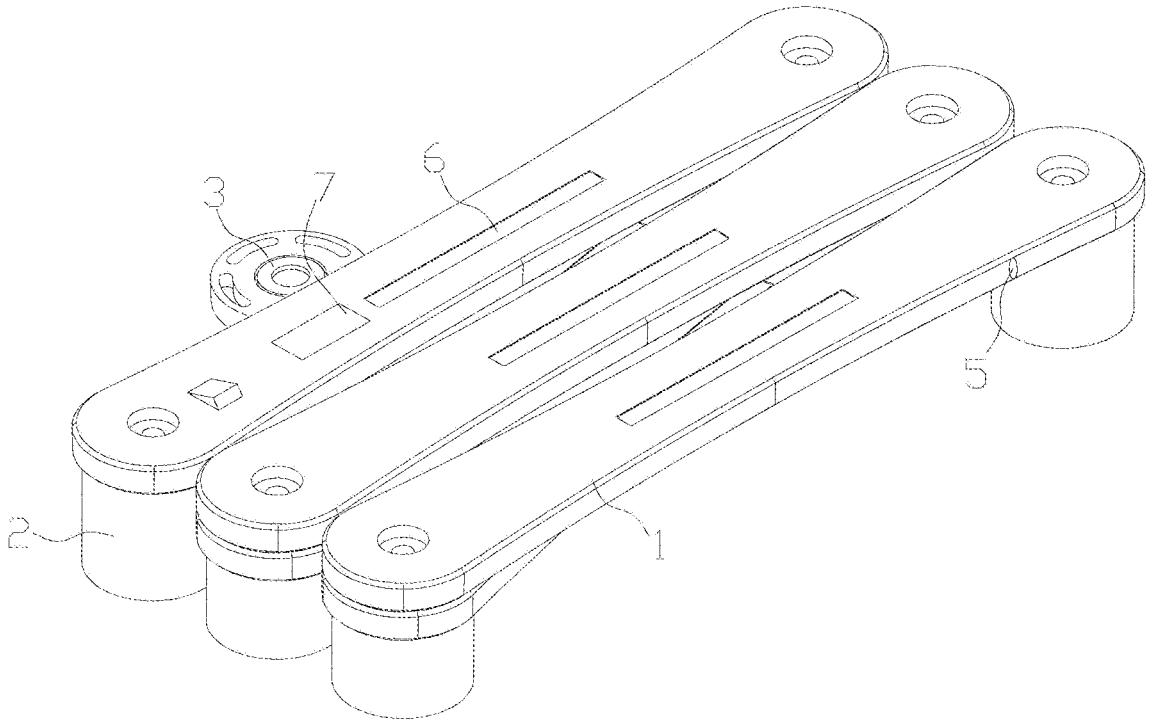
FIG. 3 is a three-dimensional structural schematic view of the ball control skill training device shown in FIG. 1 when it is folded.
Figure 6:
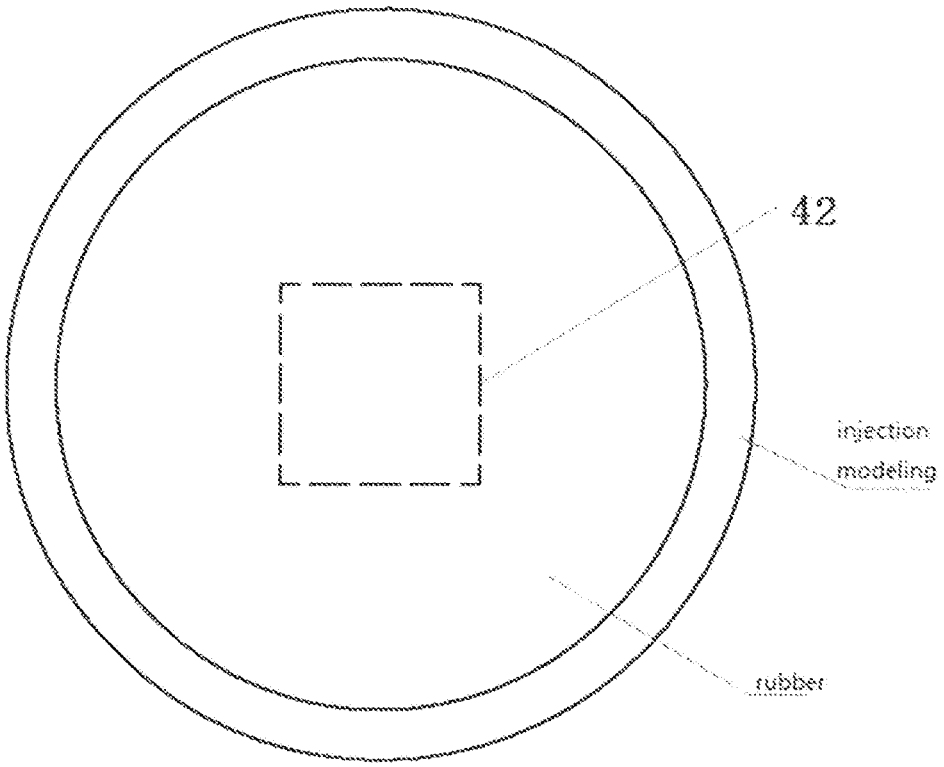
FIG. 6 is a schematic view of a plane of a ball in the ball control training device for ice hockey according to another embodiment of the present invention.

With reference to FIGS. 1-3, a ball control skill training device for ice hockey according to an embodiment of the present invention is shown schematically, compromising a plurality of cross members 1 hinged end to end, and the connecting ends of two adjacent cross members 1 are provided with a fixing component 2 for connecting and fixing. The ball control skill training device for ice hockey also compromises a ball, an LED lighting component 3, and an induction component. The induction component compromises a plurality of Hall elements 41 and electromagnetic induction elements 42. A plurality of Hall elements 41 are respectively provided on a plurality of cross members 1, and the electromagnetic induction pieces 42 is provided in the ball 3; when the ball 3 passes through the corresponding area under the cross member 1, the electromagnetic induction element 42 can trigger induction with the Hall element 41. The fixing component 2 in this embodiment is a hinge buckle.

The present invention provides a device for ice hockey ball training. During the training process, when the ball 3 passes under the cross member 1, the electromagnetic induction element 42 can trigger the induction with the Hall element 41; compared with the ball control device in the prior art, the device has more accurate induction. The device is improved under the existing technology, and Hall induction element is adopted to improve the induction accuracy, so that the training data of the device is more accurate and the training effect is improved.

In this embodiment, five cross-members 1 are provided. The five cross-members 1 can be hinged at both ends. When the cross-member 1 is placed on a plane through the fixing component 2, the bottom end surface of the cross-member 1 has a certain distance from the ground for the ball 3 to pass through. The cross members 1 at the head and tail ends are also provided with cross members 1, that is, six fixing components 2 are provided. Five Hall elements 41 are also provided, and the five Hall elements 41 are respectively provided on the lower end surfaces of the five cross members 1.

With reference to FIGS. 1-3, the ice hockey ball control skill training device further compromises a controller 5 and a plurality of LED lighting components 6; the controller 5 in this embodiment is a single-chip microcomputer, and the number of LED lighting components 6 is equal to the number of cross members 1, which are both five; the controller 5 is arranged inside one of the cross members 1, the five LED lighting components 6 are respectively arranged on the end surfaces of the five cross members 7, the controller 5 is connected with the five LED lighting components 6 and five induction components respectively. The controller 5 is used to control the LED lighting component 6 and cooperate with the induction component to jointly control the LED lighting component 6 to emit light.

With reference to FIGS. 1-3, the hockey ball control skill training device further compromises a chronograph counter 7, the chronograph counter 7 is provided on one of the cross members 1, the chronograph counter 7 is connected to five Hall elements 41; the chronograph counter 7 is configured to count the number of inductions of the electromagnetic induction element 42 and the Hall element 41 in the ball 3. The timer counter 7 is used to count training data.

With reference to FIG. 4, the ice hockey ball control skill training device further compromises a control switch 81, which is provided on one of the fixing components 2. The control switch 81 is used to turn on/off the device. The mode switch adjusts the difficulty.

With reference to FIG. 4, the hockey ball control skill training device further compromises a mode selection switch 82, and the mode selection switch 82 is provided on one of the fixing components. The mode selection switch is used to select the training difficulty mode of the device.

With reference to FIG. 4, the ice hockey ball control training device further compromises a charging port 83 and a charging indicator 84. The charging port 83 and the charging indicator 84 are provided on one of the fixing components 2. The charging port 83 and the charging indicator 84 are used to charge the device and indicate the power status.

In this embodiment, the ball 3 compromises a main body and two vertically distributed ball covers. The central portion of the main body is provided with an installation cavity for installing the electromagnetic induction element 42. The main body is a rubber. The two ball covers are provided on the upper and lower end surfaces of the main body. The electromagnetic induction element 42 is sealed in the installation cavity of the main body, and then encapsulated by two ball covers.

The power supply mode of the device can be either the access-type power supply or the battery power supply, and the power supply mode can be set according to requirements. The chronograph counter 7 is provided with a display screen, which is located on the end surface of the cross member 1 at the head end, and the display screen is used to display the time and measurement data of the chronograph counter 7.

With reference to FIGS. 1-3, the fixing component 2 compromises a fixing column and a bolt, and the cross member 1 is installed on the fixing column through the bolt.

Embodiment 2

In this embodiment, the central portion of the main body 31 is provided with an installation cavity for mounting the electromagnetic induction element 42. The electromagnetic induction element 42 is integrally wrapped by a rubber coating process, and then plastic-wrapped by an injection molding process outside the rubber.

The structures of the first and second embodiments of the device are roughly similar, and the specific working principles are as follows:

First of all, according to the requirements of training, the adjacent cross-members 1 can be set at different angles, so that the training device is set into different shapes; turn on the control switch 81, so that the training device is in a state of being energized. Then, enter the training mode and select the training difficulty. The controller 5 lights the LED lighting components on the cross member 1 at random, and the Hall element 41 below the cross-member 1 is in working state. The athletes are prompted by the LED lighting components 6 to put the ice ball into the effective area below the cross member 1 where the LE) lighting component 6 is lit. If passing successfully, the Hall element 41 and the electromagnetic induction element 42 on the ball 3 trigger induction, then the chronograph counter 7 counts up by one; the controller 5 randomly lights another LED lighting component 6 according to the training requirements, and the athlete needs to put the ice hockey into the effective area below the cross-member 1 where the LED lighting component 6 is lit. If successfully passing, the Hall element 41 and the electromagnetic induction element 42 triggers Hall induction, the chronograph counter 7 counts up again. Repeating the above, when reaching the prescribed time and completing the training, the chronograph counter 7 counts the total number of times the training object passes through the cross member 1 to evaluate the training effect.

The training device for controlling the ball of the ice hockey provided by the present invention can improve the induction accuracy of the ball 3 passing through the cross member 1; thereby improving the accuracy of the training data.

A. The traditional training method for ice hockey ball control does not have the functions of sending signals and induction technology. The present invention breaks through the tradition and adds digitization and informatization to the training method. Therefore, the present invention constitutes the innovative features of digitization, informationization and sceneization, and breaks the backward form of traditional training methods;

B. In ice hockey, the four basic personal ice hockey skills are passing, controlling, shooting and sliding, where ball control is a necessary skill for athletes. If ball control skill cannot achieve effective ball control, no matter whether it is positioning or during the sliding process, whether it can control the ball to pass through the crowd and opponents is one of the most important and necessary skills for the offensive and defensive players; using the present invention patent for training can effectively improve the athlete's personal ability, improving the athlete's competitive level and the ability to win in the competition.

C. The same with other ball sports is the importance of personal skills. The difference is that ice hockey is the fastest team ball project. Every skill training needs more professional and skillful training products. Obviously, the training device provided by the present invention can meet the above requirements.

D. This product can also add various programming software with action signals, and cooperate with the signal system with luminous function, and the digital sensor system, so that compared with the ordinary ball control training device, this product has formed information, digital and scene-oriented product characteristics, breaking the backward situation of traditional ice hockey training equipment in the past 20 years, and meeting the training needs of a new generation of players growing in an intelligent and technological environment.

What has been described above is merely some specific embodiments of the present invention. For those ordinary skilled in the art, several modifications and improvements can be made without departing from the inventive concept of the present invention, which are all within the scope of protection of the present invention.

What is claimed is:

1. A ball control skill training device for ice hockey comprising:

a plurality of cross members (1) hingedly connected end to end, wherein connecting ends of adjacent cross members (1) are provided with a fixing component (2) for hingedly connecting the plurality of cross members together;

a puck (3), an LED lighting assembly, and an induction component, wherein the induction component comprises a plurality of Hall effect elements (41);

wherein the plurality of Hall effect elements (41) are respectively provided on each of the plurality of cross members (1);

an electromagnetic induction element (42) provided in the puck (3); and a chronograph counter (7), provided on one of the plurality of cross members (1);

wherein when the puck (3) passes under any of the plurality of cross member, the electromagnetic induction element (42) in the puck, triggers at least one of the plurality of Hall effect elements positioned on the plurality of cross members through induction;

wherein the chronograph counter is connected to the plurality of Hall effect elements (41) and is configured to count the number of triggering of the Hall effect elements (41) by the electromagnetic induction element (42) in the puck (3) within a predetermined time.

2. The ball control skill training device for ice hockey according to claim 1, further comprising a controller (5) and a plurality of LED lighting components (6), the controller (5) is provided on one of the fixing components (2), the plurality of the LED lighting components (6) are respectively provided on each end of the plurality of cross members (1), and the controller (5) is respectively connected to the LED lighting components (6) and the induction components.

3. The ball control skill training device for ice hockey according to claim 2, further comprising a control switch (81), a mode selection switch (82), a charging port (83), and a charging indicator (84), wherein the control switch (81), the mode selection switch (82), the charging port (83) and the charging indicator (84) are provided on one of the fixing components (2).

4. The ball control skill training device for ice hockey according to claim 3, wherein, the fixing component (2) compromises a fixing column and a carriage bolt, and the cross member is mounted on the fixing column through the carriage bolt.

5. The ball control skill training device for ice hockey according to claim 4, wherein the puck (3) compromises a main body (31) and an upper and a lower two-ball covers (32) distributed up and down, a central part of the main body (31) is provided with an installation cavity for installing the electromagnetic induction element (42), which seal the installation cavity.

6. The ball control skill training device for ice hockey according to claim 4, wherein, a central portion of the main body (31) is provided with an installation cavity for installing the electromagnetic induction element (42), and an outer surface of the electromagnetic induction element (42) is integrally wrapped by a rubber coating process, and an outer surface of the rubber is injection-wrapped by an injection molding process.

* * * * *